United States Patent [19]

Kakehasi

[11] 4,142,437

[45] Mar. 6, 1979

[54] ENVELOPE CIRCUIT FOR A KEYBOARD TYPE ELECTRONIC MUSICAL INSTRUMENT

[75] Inventor: Ikutaro Kakehasi, Osaka, Japan

[73] Assignee: Roland Corporation, Osaki, Japan

[21] Appl. No.: 817,019

[22] Filed: Jul. 19, 1977

Related U.S. Application Data

[63] Continuation of Ser. No. 656,695, Feb. 9, 1976, abandoned.

[30] Foreign Application Priority Data

Mar. 31, 1975 [JP] Japan ..... 50-39665

[51] Int. Cl.[2] ..... G10H 1/02; 307 263;264;292

[52] U.S. Cl. ..... 84/1.24; 84/1.26; 84/DIG. 8

[58] Field of Search ..... 84/1.01, 1.09, 1.1, 84/1.13, 1.24, 1.26, 1.27, DIG. 23, DIG. 7

[56] References Cited

U.S. PATENT DOCUMENTS

| | | | |
|---|---|---|---|
| 3,557,296 | 1/1971 | Hirose | 84/1.26 |
| 3,602,628 | 8/1971 | Peterson | 84/1.26 |
| 3,634,594 | 1/1972 | Hiyama | 84/1.1 |
| 3,651,730 | 3/1972 | Adachi | 84/1.24 |
| 3,816,636 | 6/1974 | Peliz | 84/1.1 |

*Primary Examiner*—Robert K. Schaefer
*Assistant Examiner*—Vit W. Miska
*Attorney, Agent, or Firm*—Wenderoth, Lind & Ponack

[57] ABSTRACT

An envelope circuit for a keyboard type electronic musical instrument having a damping and sustain characteristic. The circuit has a keyswitch operated in association with the actuation of a key on the keyboard of the electronic musical instrument to connect a power supply to a voltage responsive circuit for producing a decreasing volume output tone. A sustain circuit is coupled to the voltage responsive circuit for sustaining the operation of the voltage responsive circuit and is connected through a blocking diode to a sustain switch common to all the envelope circuits in the musical instrument. The sustain switch is connected in the sustain circuit for bypassing the voltage supplied thereto from a time constant circuit when the sustain switch is closed for making the sustain circuit inoperative to deenergize the voltage responsive circuit, whereby the voltage responsive circuit continues to produce an output tone independently of how the keyswitch is restored to its initial position. There can thus be realized a musical tone effect the same as that produced by the sustain pedal of a piano.

5 Claims, 8 Drawing Figures

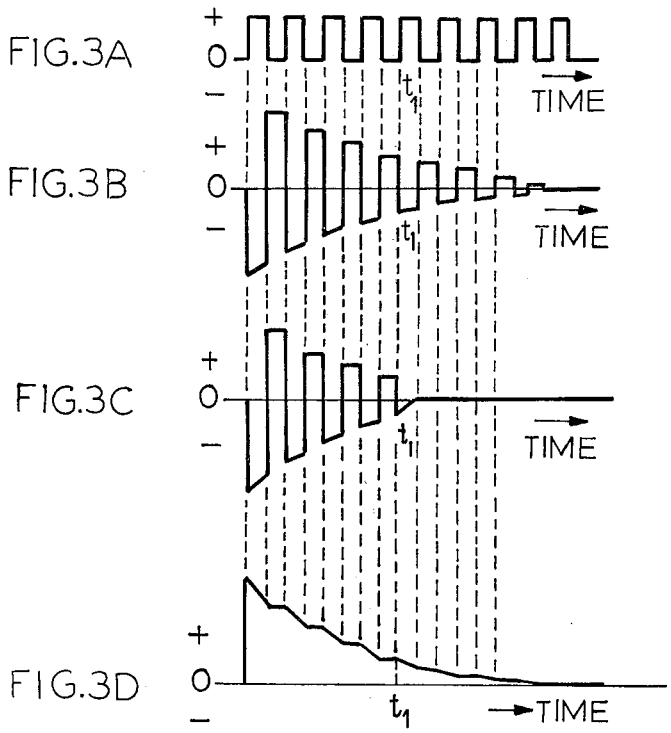
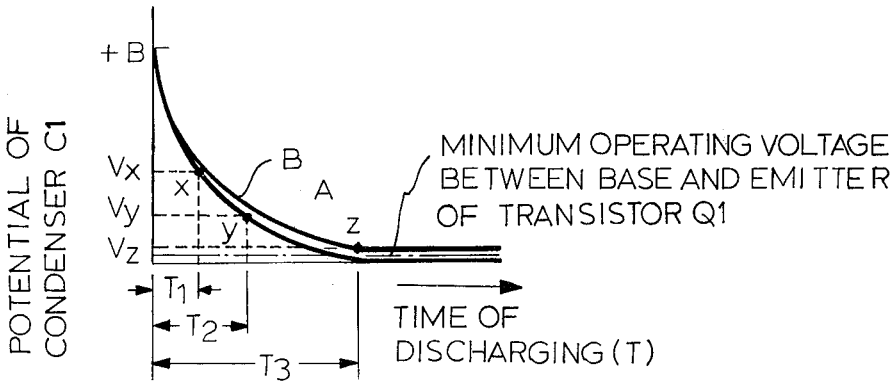
FIG 5

ENVELOPE CIRCUIT FOR A KEYBOARD TYPE ELECTRONIC MUSICAL INSTRUMENT

This is a continuation, of application Ser. No. 656,695, filed Feb. 9, 1976, abandoned.

This invention relates to an envelope circuit for a keyboard type electronic musical instrument, wherein the output of the instrument may be varied by varying the strength with which the keys are struck and a damping effect accompanies the output thereof.

BACKGROUND OF THE INVENTION AND PRIOR ART

In known keyboard type electronic musical instruments wherein the output can be varied by varying the strength with which the keys are struck, an induced voltage due to the interaction of a coil and a magnet is utilized, or the time needed for switching the key switch which is operated by the key being struck is utilized. An example of the latter system will be described with reference to FIG. 1.

FIG. 1 shows a well-known circuit for a keyboard type electronic musical instrument in which a key 5 having a transfer rod 4 is adapted to be moved vertically by a force represented by the arrow to switch the movable contact 1 of switch S from the break contact 2 to the make contact 3. A parallel connected capacitor 6 and a resistor 7 constituting a time constant circuit are connected to the movable contact 1, and a gate circuit 9 is adapted to be actuated to gate the output of an original tone oscillator 10 by an envelope signal from a generator circuit 8 connected to the make contact 3, so that the output waveform from the oscillator is supplied to the output terminal 11. A D.C. power source E' is connected to contact 2. If the key 5 having the transfer rod 4 thereon is displaced in the direction of the arrow by a player, the movable contact 1 of the keyswitch S will be transferred from the break contact 2 on which a D.C. potential of the source E' is impressed, to the make contact 3. The transfer speed of the contact 1 is proportional to the speed of movement of the key 5 being struck. At the instant the movable contact 1 of the keyswitch S leaves the break contact 2, the charge on the capacitor 6, which has been charged by the D.C. source E' up to that moment, will begin to discharge through the resistor 7 so that the potential across the capacitor 6, which is supplied to the make contact 3 of the keyswitch S, will have a magnitude which is reduced in proportion to the exponential function of the time necessary for the completion of movement of the keyswitch S. In other words, the make contact 3 of the key switch S will be supplied with a greater voltage for higher speed of the key being struck than for a lower speed thereof. The output signal of the envelope signal generating circuit, which is driven by the voltage applied to the make contact 3, is introduced into the gate circuit 9, whereby the output of the original tone oscillator is transformed into a signal, the magnitude of which is substantially proportional to the speed with which the key is struck, so that a musical tone signal is taken out from the output terminal 11.

However, if the circuit of FIG. 1 is to be utilized in an electronic musical instrument which can be played so as to produce tones similar to a piano, a damper device is necessary in addition to the elements described above. That is, in an ordinary, mechanical piano, if the sustain pedal is activated, the damper means will be moved so as to be free of the strings, whereby the tone created by the key being struck will be sustained, even if the key is restored to its initial position, and the tone will only be extinguished along a predetermined damping curve. But means are provided by which, when the pedal is not actuated, the tone will die away at the same time as the key is restored to its initial position.

Such a damper also plays a very important role in an electronic piano. To provide the circuit according to FIG. 1 with a sustain effect, another damper circuit having a switch as a part thereof would be necessary. However, in a practical musical instrument having a plurality of keys, the provision of added switches for the respective key circuits to attain a sustain effect would lead to considerable disadvantages, such as an increase in the number of parts for such circuits, a higher rate of the occurrence of faults, a higher cost of the instrument, and difficulty in gating tone signals by the envelope signals without damaging the tone signal envelope.

OBJECT AND BRIEF SUMMARY OF THE INVENTION

It is an object of this invention to provide an improved circuit for a keyboard type electronic musical instrument, wherein the above stated disadvantages are overcome, and only a single switch and a very simple circuit therefor for each of the plurality of keys will produce the necessary damping and sustain effects corresponding to those of a piano.

It is a further object of the invention to provide the envelope circuit with an improved pianissimo circuit in which a minimum voltage is always supplied to the circuit so that regardless of how long it takes the keyswitch to be operated, a minimum volume tone will be produced.

These objects are achieved by an envelope circuit for a keyboard type electronic musical instrument according to the invention which has a damping characteristic in which the switching time of the keyswitch is proportional to the speed of the key being struck, and the magnitude of the output signal is proportional to the switching speed of said key switch. In the envelope circuit, a resistor is connected in series with a time constant circuit consisting of a parallel connected condenser and a resistor, and damping circuit means for producing a damping effect is connected across said time constant circuit in which a damping action is initiated simultaneously with the key being struck, the damping character of which can optionally be continued or be cut off independently of the time the key is restored to its initial position.

The pianissimo circuit is constituted by a variable resistance coupled to said power supply and a further resistance coupled between the variable resistance terminal of said variable resistance and the time constant circuit for supplying a minimum voltage through either the keyswitch or the damping circuit means for producing an output from said circuit, regardless of the length of time necessary for operation of said keyswitch.

BRIEF EXPLANATION OF THE DRAWINGS

The invention will now be explained in greater detail with reference to the accompanying drawings, in which:

FIGS. 3A–3D are waveform diagrams for illustrating the operations of the envelope circuit according to this invention;

FIG. 5 is a graph showing the relation between the potential and the discharging time of the condenser C1 in the above circuit.

DETAILED DESCRIPTION OF THE INVENTION

Figure 1:
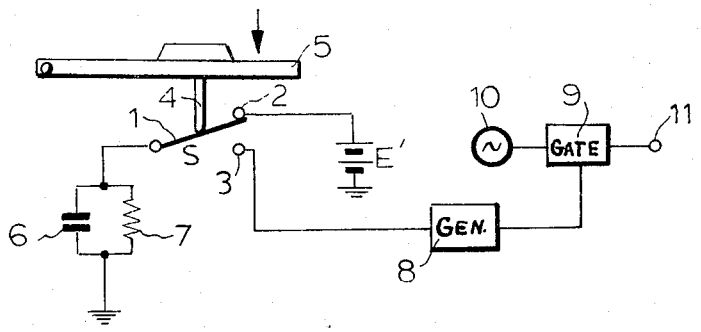
(PRIOR ART) FIG.1
FIG. 1 is a schematic circuit diagram of an envelope circuit for the conventional keyboard type electronic musical instrument.
Figure 2:
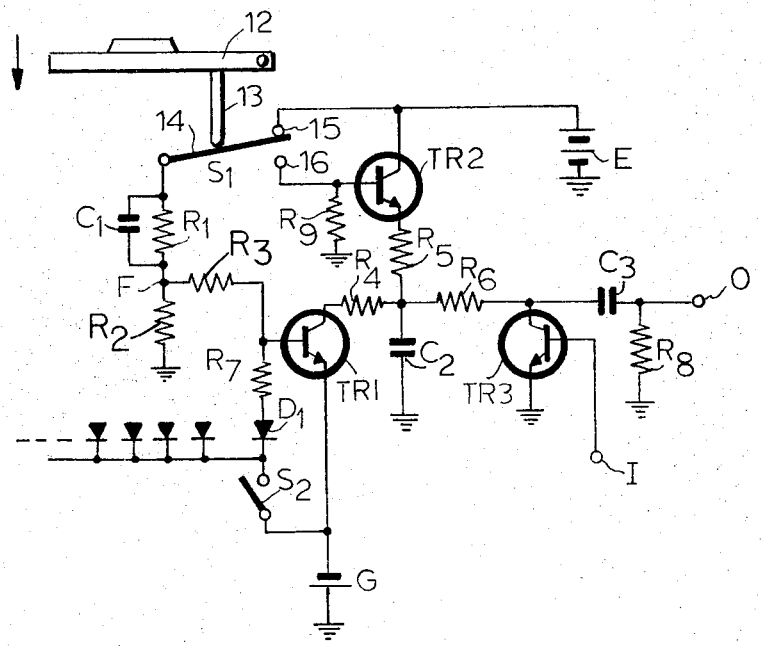
FIG. 2 is a circuit diagram of the envelope circuit according to this invention.

Referring to FIG. 2, wherein an envelope circuit according to this invention is shown, a key 12 is provided for each note and when struck will move vertically to switch a movable contact 14 of a corresponding keyswitch $S_1$ from the break contact 15 to the make contact 16 thereof by means of the transfer rod 13 attached thereto. A time constant circuit made up of a parallel connected capacitor $C_1$ and a resistor $R_1$ is connected to the movable contact 14. A D.C. source E supplies a potential of $+10 \sim 30V$ to the time constant circuit through the break contact 15 in the normal condition of movable contact 14. A D.C. source G supplies $-0.3 \sim 0.5V$ to the emitter of a transistor $Tr_1$, the base of which is connected to the time constant circuit through a resistor $R_3$ in parallel with a grounded divider resistor $R_2$. A voltage responsive circuit is provided which has a transistor $Tr_2$ with the collector emitter circuit thereof connected between voltage source E and a capacitor $C_2$ through a resistor $R_5$. The collector of transistor $Tr_1$ is connected to the capacitor $C_2$ through discharging resistor $R_4$. A sustain switch $S_2$ and resistor $R_7$ are connected across the base and emitter of transistor $Tr_1$. The voltage responsive circuit further has a resistor $R_6$, which is a loading resistor connected to a transistor $Tr_3$, and also connected as a discharging resistor to the capacitor $C_2$. The voltage responsive circuit further includes a coupling capacitor $C_3$ and an output terminal O connected to discharging resistor $R_6$. An input terminal I for introducing the output of a tone source oscillator is connected to the base of transistor $Tr_3$. A diode $D_1$ is connected between resistor $R_7$ and sustain switch $S_2$, which is common to all the envelope circuits for all the keyswitches of the instrument, to prevent mutual influences among these circuits. Resistor $R_7$ has a resistance which is very small compared to that of $R_3$ so that when switch $S_2$ is closed, the base of transistor $Tr_1$ is bypassed and the transistor is in the off state, while when the switch $S_2$ is open, transistor $Tr_1$ is biased to the on condition by the voltage at point F.

FIGS. 3A–3D show several waveforms occurring at various points in the circuit according to this invention during the operation thereof. FIG. 3A shows the waveform generated by the original tone oscillator which is applied to the input terminal I of transistor $Tr_3$ in FIG. 2. FIG. 3B is the voltage waveform produced at the output terminal O when a key 12 is struck while the sustain switch $S_2$ is closed. FIG. 3C is the voltage waveform produced at the output terminal O when a key 12 is struck while the sustain switch $S_2$ is opened and the key is restored at time $t_1$. FIG. 3D is the voltage waveform applied to the collector of the transistor $Tr_3$.

The operation of the damping circuit will be described for each position of the sustain switch $S_2$.

OPERATION WHEN SUSTAIN SWITCH $S_2$ IS OPEN

When the key 12 is in the restored or rest state thereof, the movable contact 14 of the keyswitch $S_1$ is on the break contact 15, so that the capacitor $C_1$ is charged by the power source E and a positive potential will be produced at the point F. Accordingly, a base current for the transistor $Tr_1$ will flow through the resistor $R_3$ to turn transistor $Tr_1$ on, and there will be formed a circuit of comparatively low resistance through resistor $R_4$ and the collector-emitter circuit of transistor $Tr_1$. Any charge which has been built up on capacitor $C_2$ will therefore be discharged within a relatively short time.

When the movable contact 14 of the keyswitch S1 is switched from the contact 15 to the contact 16 when the key 12 is struck, the switching speed is proportional to the speed with which the key 12 on the keyboard is actuated. The charge on the capacitor $C_1$ of the time constant circuit $R_1$–$C_1$ which has been charged by the power source E while contact 14 was connected to contact 15, will begin to discharge through the resistor $R_1$ starting at the instant the contact 14 of the keyswitch $S_1$ is separated from the contact 15. Therefore, the potential which remains on the capacitor $C_1$ at the end of the time required for changeover of switch $S_1$, which potential will fall exponentially as a function of time during the time needed for changeover of the switch $S_1$, will be applied to the contact 16 of the keyswitch $S_1$. That is to say, a higher potential will be impressed on the contact 16 of the keyswitch $S_1$ for a higher speed of key actuation (shorter discharging time T) than at a lower speed of key actuation (longer discharging time T). In other words, a potential depending on the intensity of key actuation will be applied to the base of a transistor $Tr_2$. At the same time, the voltage at point F will become zero, thus causing transistor $Tr_1$ to become non-conductive. In addition, capacitor $C_2$ will be charged through the resistor $R_5$ by the emitter current of transistor $Tr_2$. Since transistor $Tr_1$ is non-conductive, the potential across the capacitor $C_2$ will cause the collector of the transistor $Tr_3$ to be impressed with a positive potential through the resistor $R_6$. This potential is substantially proportional to the speed of key actuation. Since the base of the transistor $Tr_3$ is impressed with a sufficiently high amplitude of a musical tone signal, the waveform of which is illustrated in FIG. 3A, through the input terminal I from a tone source oscillator, the transistor $Tr_3$ will be conductive every positive half-cycle of said musical tone signal, whereby the charge on the capacitor $C_2$ will continue to discharge in accordance with the time constant of a circuit consisting of the load resistor $R_6$, transistor $Tr_3$ and capacitor $C_2$ until the time when the potential across said capacitor $C_2$ has become substantially zero. At the output terminal O, to which the output from transistor $Tr_3$ is supplied through a capacitor $C_3$ connected in series therewith, will be produced an output musical signal having a damped characteristic as shown in FIG. 3(B). FIG. 3(D) shows the envelope representing the damped characteristic of said output.

Now, if the finger of the player is removed from the key 12 after time $t_1$ from the instant the key was struck, the movable contact 14 of the keyswitch $S_1$ will be returned to the stationary contact 15 to return the keyswitch $S_1$ to the original state, whereby the capacitor $C_1$ will again be charged from the source E to cause the potential at point F to become positive. Accordingly, a current will flow through the resistor $R_3$ to the base of the transistor $Tr_1$ to make it conductive, so that the charge on the capacitor $C_2$ will be discharged through resistor $R_4$ and transistor $Tr_1$ within a relatively small magnitude of the time constants of resistor $R_4$ and of transistor $Tr_1$, thereby to produce an output musical signal at the output terminal O, the damped characteristic of which will be as shown by the waveform of FIG. 3C, which is similar to the wave shown in FIG. 3B, but which has been cut off at time $t_1$. In other words, an output will appear at the output terminal O only while the movable contact 14 is connected to the contact 16 of the keyswitch $S_1$ as a result of the key having been struck, said output having a damped character.

OPERATION WHEN SUSTAIN SWITCH $S_2$ IS CLOSED

The operation of the circuit when switch $S_2$ is closed is the same as when switch $S_2$ is open up to the time the key 12 is released.

When the finger of the player is removed from the key 12, however, the movable contact 14 of the keyswitch $S_1$ will be restored to the break contact 15, so that the capacitor $C_1$ will again be charged to make the potential at point F positive. Nevertheless, the transistor $Tr_1$ does not become conductive, the potential of the base of the transistor $Tr_1$ being too low positive voltage to make the transistor $Tr_1$ become conductive as the electric charge of the point of the base of the transistor $Tr_1$ is discharged through the switch $S^2$, the diode $D_1$ and the resistor $R7_1$. The discharge of the capacitor $C_2$ therefore continues in the same way as if the key 12 was fully depressed as long as the sustain switch $S_2$ is closed. A similar effect is produced as is produced by the sustain pedal on a conventional mechanical piano.

The circuit according to this invention is thus much simpler than the prior art circuit, wherein a circuit for generating the envelope signal and a gate circuit are combined to produce a damping effect, and by merely providing a single keyswitch $S_1$ an adequate touch can be obtained. At the same time, a single sustain switch $S_2$ common to all the keys can produce a sustain effect which can be continued or stopped independently of the time the key is restored after it has been struck. This invention thus has the advantage, particularly with respect to a keyboard type electronic musical instrument requiring as many identical circuits as the number of keys, that it may be constructed with fewer parts, and a sustain effect can be achieved by merely adding a single sustain switch $S_2$.

The foregoing envelope circuit can be improved further by the provision of a pianissimo circuit means. If a key is actuated by a player very delicately, namely a note is played pianissimo, the time needed in such a case for the movable contact 14 to be switched over from one stationary contact 15 to the other contact 16 is quite long, and accordingly too much of the charge on the capacitor $C_1$ may be discharged as shown by curve A in FIG. 5, and as a result, when movable contact 14 finally contacts the contact 16, the necessary minimum voltage between the base and emitter of the transistor $Tr_2$ may not be present, in which case transistor $Tr_2$ does not become conductive, and no musical signal appears at the output terminal O.

Figure 4:
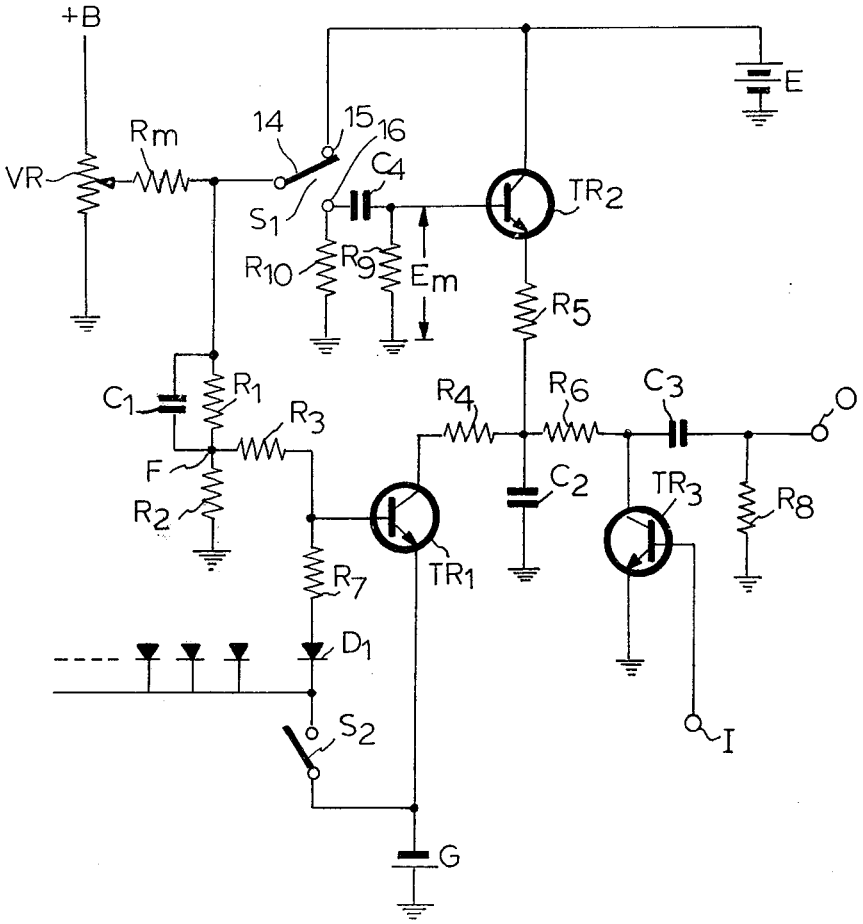
FIG. 4 is a circuit diagram of a touch sense circuit according to this invention for producing an adequate pianissimo tone volume.

This difficulty can be overcome by adding to the circuit of FIG. 2 as shown in FIG. 4. The time constant circuit consisting of capacitor $C_1$ and resistor $R_1$ is connected through resistor Rm with a variable resistor VR, which is connected to the power source +B. The magnitude of resistance of said resistor Rm is sufficiently larger than that of $R_1$, so that a potential can be applied to said time constant circuit which is as minute as desired, so that a discharge characteristic as shown by the curve B of FIG. 5 can be achieved. Thereby the minimum potential necessary for tone production (corresponding to Vz in FIG. 5) will always be provided. With the circuit arrangement as described above, even if the movable contact 14 moving from the stationary contact 15 to the stationary contact 16 takes longer than the discharge time for capacitor $C_1$, a voltage will be applied to contact 16 which has been divided by the resistors Rm, $R_1$ and $R_2$, so that the base of the transistor $Tr_2$ is furnished through the switched-over contact 16 with a minimum potential needed for producing a pianissimo tone signal at output O.

Further, a similar effect can also be obtained by an arrangement wherein the variable resistor VR is connected through resistor Rm with the point F, so that the desired minute potential is impressed through the resistor $R_3$ on the base of the transistor $Tr_1$.

Thus, with the pianissimo circuit means according to this invention, by virtue of the addition of a simple variable resistor VR and a resistor Rm, an adequate pianissimo effect is produced.

What is claimed is:

1. In a keyboard type of electronic musical instrument, a plurality of envelope circuits having a damping and sustain characteristic and each comprising a keyswitch operated in association with the actuation of a key on the keyboard of the electronic musical instrument, a power supply, a voltage responsive circuit coupled to said power supply for producing an output tone, the volume of which decreases as the magnitude of the voltage applied thereto decreases, a sustain circuit means coupled to said voltage responsive circuit for causing the operation of said voltage responsive circuit to continue, a time constant circuit means having a first resistance having a first terminal connected to said keyswitch and a second terminal and a first capacitance having a first terminal connected to the first terminal of said first resistance and to said keyswitch and a second terminal connected to the second terminal of said first resistance, said first capacitance being coupled to said power supply in the normal position of said keyswitch for being charged thereby and being coupled to said voltage responsive circuit when said keyswitch is in the other position with the key actuated for delivering a decreasing voltage to said voltage responsive circuit, the initial magnitude of which is proportional to the time which said keyswitch takes to move from the normal position to the other position, a second resistance connected between the junction of the second terminals of said first resistance and said first capacitance and said sustain circuit means in series with said first resistance for providing a voltage to said sustain circuit means when said keyswitch moves away from said other position toward said normal position when the key is released for causing said sustain circuit means to deenergize said voltage responsive circuit, third resistance connected between the junction of the second terminals of said first resistance and said first capacitance and ground, a single sustain switch for all said envelope circuits connected in parallel to said sustain circuit means in each envelope circuit for bypassing said voltage supplied to said sustain circuit means from said time constant circuit when said sustain switch means is closed for making said sustain circuit means inoperative to deenergize said voltage responsive circuit, and reverse current flow preventing means for each sustain circuit means connected between the sustain circuit means and said sustain switch for preventing reverse current flow from individual sustain circuit means into other sustain circuit means, whereby said voltage responsive circuit continues to produce an output tone.

2. The improvement as claimed in claim 1 wherein said voltage responsive circuit comprises second transistor means having the base connected to said keyswitch in the other position thereof and the collector emitter circuit coupled to a power supply and having a second capacitance coupled to the collector emitter circuit thereof, and a load resistor connected to said second capacitance for producing an output signal corresponding to the output tone, and said sustain circuit means comprises a first transistor having the collector emitter circuit connected to said second capacitance of said voltage responsive circuit for conducting the charge away from said second capacitance and having the base connected to said second resistor, said sustain switch being connected to the base of said first transistor for bypassing the voltage supplied to said base.

3. The improvement as claimed in claim 1 further comprising a pianissimo circuit comprising a variable resistance coupled to said power supply and a further resistance coupled between the variable resistance terminal of said variable resistance and the time constant circuit means for supplying a minimum voltage to said voltage responsive circuit through one of said circuit means for producing an output from said voltage responsive circuit, regardless of the length of time necessary for operation of said keyswitch.

4. The improvement as claimed in claim 3 in which said further resistance is connected to said first capacitance on the side thereof toward said keyswitch.

5. The improvement as claimed in claim 3 in which said further resistance is connected between said first resistance and said second resistance.

* * * * *